US006017248A

United States Patent [19]

Pan et al.

[11] Patent Number: 6,017,248

[45] Date of Patent: Jan. 25, 2000

[54] CARD EDGE CONNECTOR

[75] Inventors: Hua-Tseng Pan, Taipei; Ching-Chang Meng, Tu-Chen; Tai-Hsu Tsai, Pan-Chiao, all of Taiwan

[73] Assignee: Hon Hai Precision Ind. Co., Ltd., Taipei Hsien, Taiwan

[21] Appl. No.: 08/924,058

[22] Filed: Aug. 28, 1997

[51] Int. Cl.[7] ..... H01R 13/64

[52] U.S. Cl. ..... 439/681

[58] Field of Search ..... 439/630–633, 439/680, 681

[56] References Cited

U.S. PATENT DOCUMENTS 3,603,915 9/1971 Jayne et al. ..... 439/633

5,387,132 2/1995 Sarver et al. ..... 439/633

5,688,147 11/1997 Coteus et al. ..... 439/633 X

*Primary Examiner*—Khiem Nguyen

[57] ABSTRACT

A card edge connector is disclosed, which comprises an elongate insulating housing including a central slot extending along a longitudinal direction thereof for receiving a daughter board, a plurality of conductive contacts provided on longitudinal sides of the central slot for mating with contact fingers formed on the daughter board, and at least one removable positioning key fixed in the insulating housing for matching a cutout formed between two adjacent contact fingers of the daughter board.

12 Claims, 5 Drawing Sheets

CARD EDGE CONNECTOR

BACKGROUND OF THE INVENTION

1. Field of the Invention

The invention relates to an electrical connector, more particular to a card edge connector.

2. The Prior Art

To fulfill the function enhancing or periphery addition of a computer, especially for a personal computer, several versatile additional card edge connectors for functional cards or interface cards are provided in the computer. A daughter board 1 and a conventional card edge connector 2 for receiving the daughter board 1 are shown in FIG. 1. In order to avoid an inversion of inserting the daughter board 1 into the connector 2 and to correctly align the contact fingers 10 of the daughter board 1 with the corresponding conductive contacts 22 of the connector 2, a positioning cutout 12 is provided between two adjacent contact fingers 10 for matching a key 23 integrally formed in the central insertion slot 21 of the connector 2. Different daughter boards are provided with positioning cutouts of different position and width. As can be seen in FIGS. 2A to 2C, a daughter board 1 for 32-bit transmission, a daughter board 1' for 64-bit transmission, and a daughter board 1" for an energy-saving computer of 3.3 Volt, all have different positioning cutout arrangements. However, the space in a computer, especially for a personal computer or even for a lap-top computer, is very limited, which in turn limits the number of card edge connectors that can be provided.

Hence, there is a need for a card edge connector that can mate with daughter boards having different positioning cutout arrangements.

SUMMARY OF THE INVENTION

Accordingly, one object of the present invention is to provide a card edge connector having removable positioning keys for mating daughter boards having different positioning cutout arrangements.

To fulfill the above-mentioned object, according to one embodiment of the present invention, a card edge connector comprises an elongate insulating housing including a central slot extending along a longitudinal direction thereof for receiving a daughter board, a plurality of conductive contacts provided on longitudinal sides of the central slot for mating with contact fingers formed on the daughter board, and at least one removable positioning key fixed in the insulating housing for matching a cutout formed between two adjacent contact fingers of the daughter board.

In one aspect, the removable positioning key according to the present invention comprises a main body and at least one fixing leg extending downward of the main body, the at least one fixing leg including at least one protrusion on a lateral side.

In another aspect, a housing for a card edge connector according to the present invention comprises an elongate insulating body, a central slot extending along a longitudinal direction of the insulating body for receiving a daughter board, and a central ridge extending on a bottom of the central slot along the longitudinal direction of the housing.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
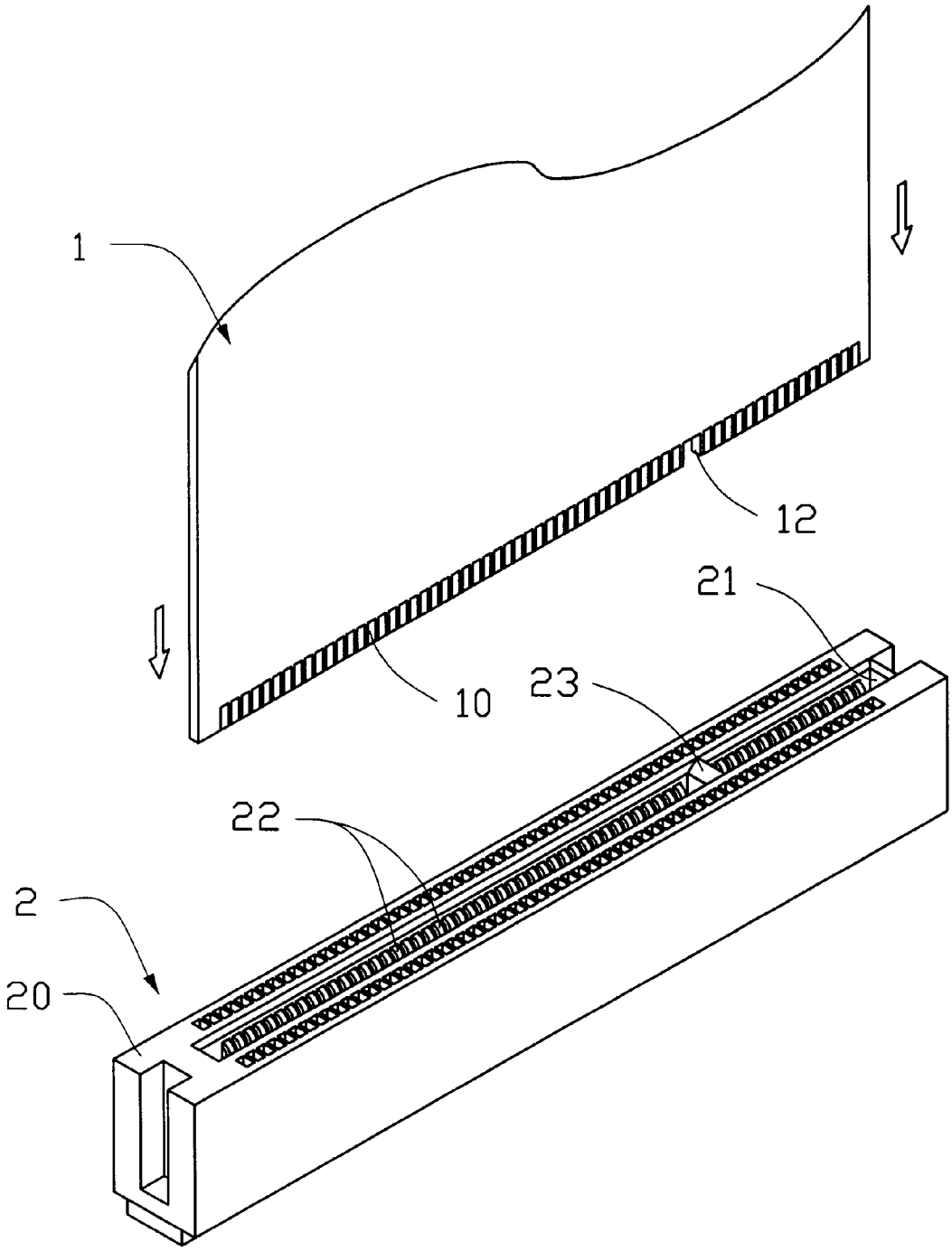
FIG.1 (PRIOR ART)
FIG. 1 shows a daughter board and a conventional card edge connector 2 for receiving the daughter board.

Reference will now be made in detail to the preferred embodiments of the present invention. It will be noted here that for a better understanding, most of like components are designated by like reference numerals throughout the various figures in the embodiments.

Figure 3:
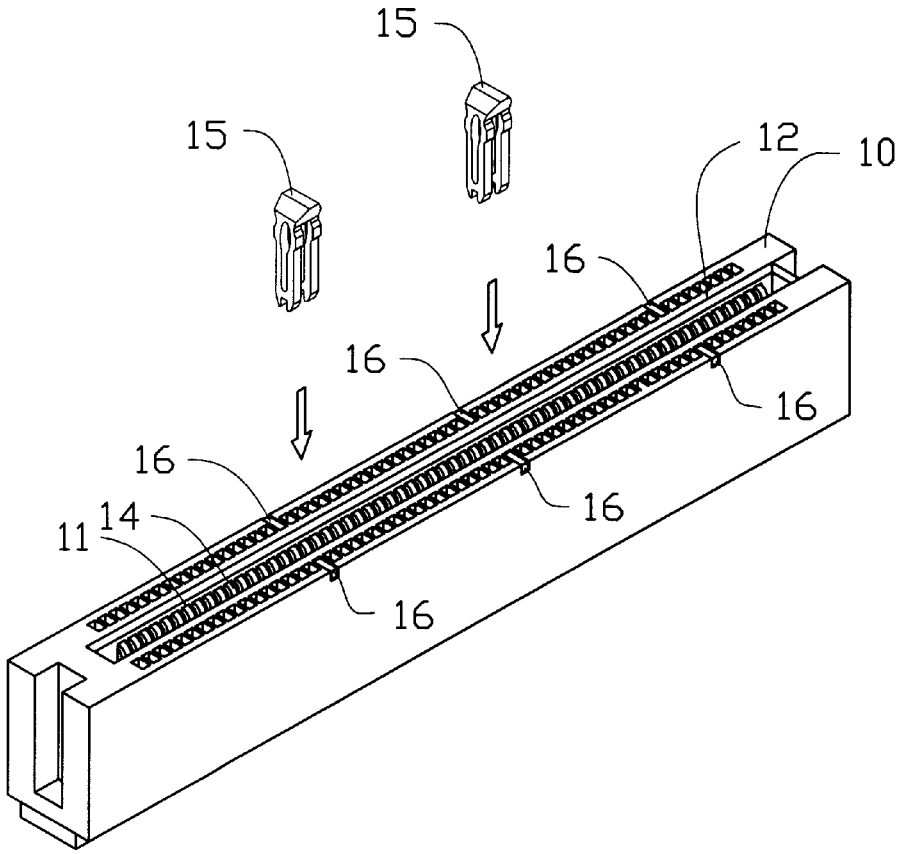
FIG. 3A is an exploded perspective view of a card edge connector according to one embodiment of the present invention.
FIG. 3B is a top plane view of the card edge connector shown in FIG. 3A.
Figure 3:
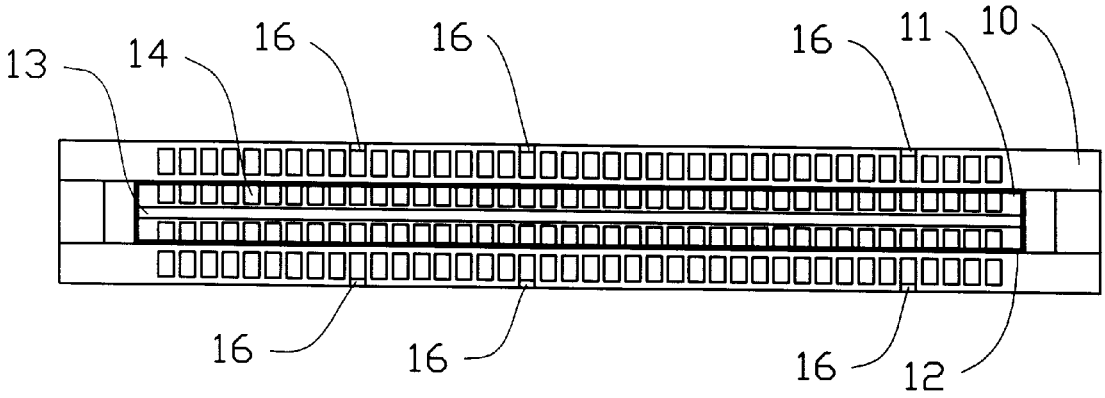

Referring now to FIGS. 3A and 3B, a card edge connector according to a preferred embodiment of the present invention mainly comprises an elongate insulating housing 10, a plurality of conductive contacts 14 received in the insulating housing 10, and two removable positioning keys 15 fixed in the insulating housing 10.

Figure 2:
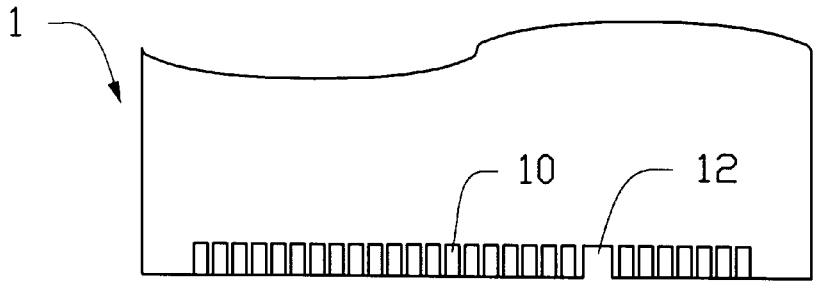
FIGS. 2A to 2C show three daughter boards of different cutout arrangements.
Figure 2:
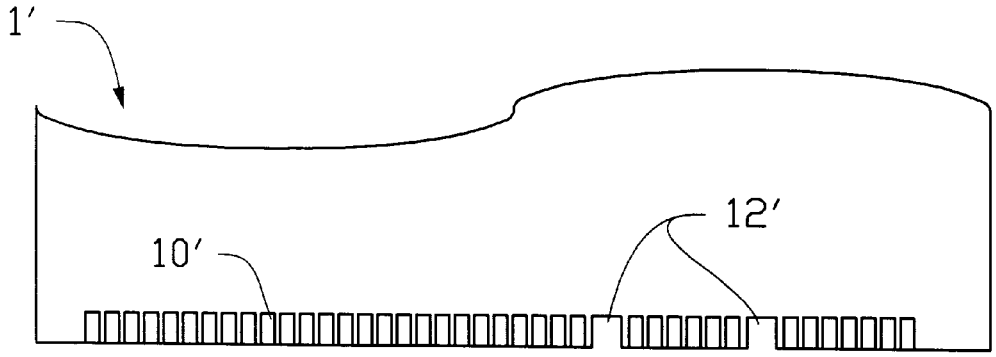
Figure 2:
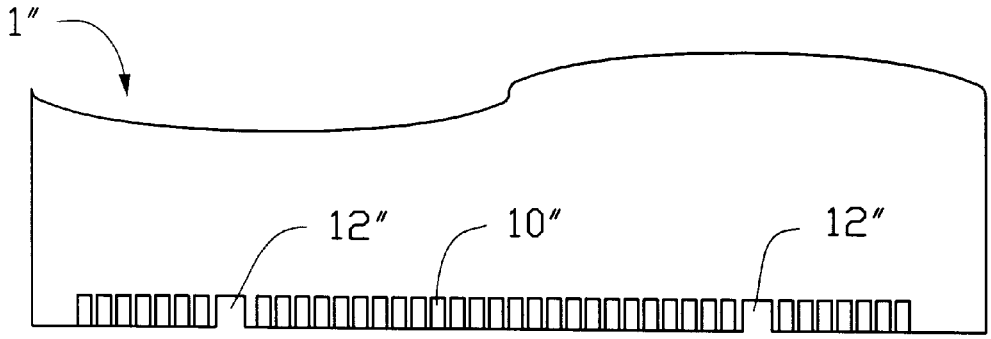

The insulating housing 10 comprises a central slot 11 extending along a longitudinal direction thereof for receiving a daughter board, such as the ones shown in FIGS. 2A to 2C, chamfered surfaces 12 formed on rim portions of the central slot 11 for guiding the insertion of both the daughter board (not shown) and the removable positioning keys 15, and a central ridge 13 formed on the bottom of the slot 11 extending along the longitudinal direction of the insulating housing 10 for positioning the removable positioning keys 15. The insulating housing 10 also comprises three marking shallows 16 for showing predetermined resting locations of the removable positioning keys 15.

Two rows of conductive contacts 14 are symmetrically provided on both longitudinal sides of the slot 11 for mating with contact fingers (not shown) formed on the daughter board.

Figure 4:
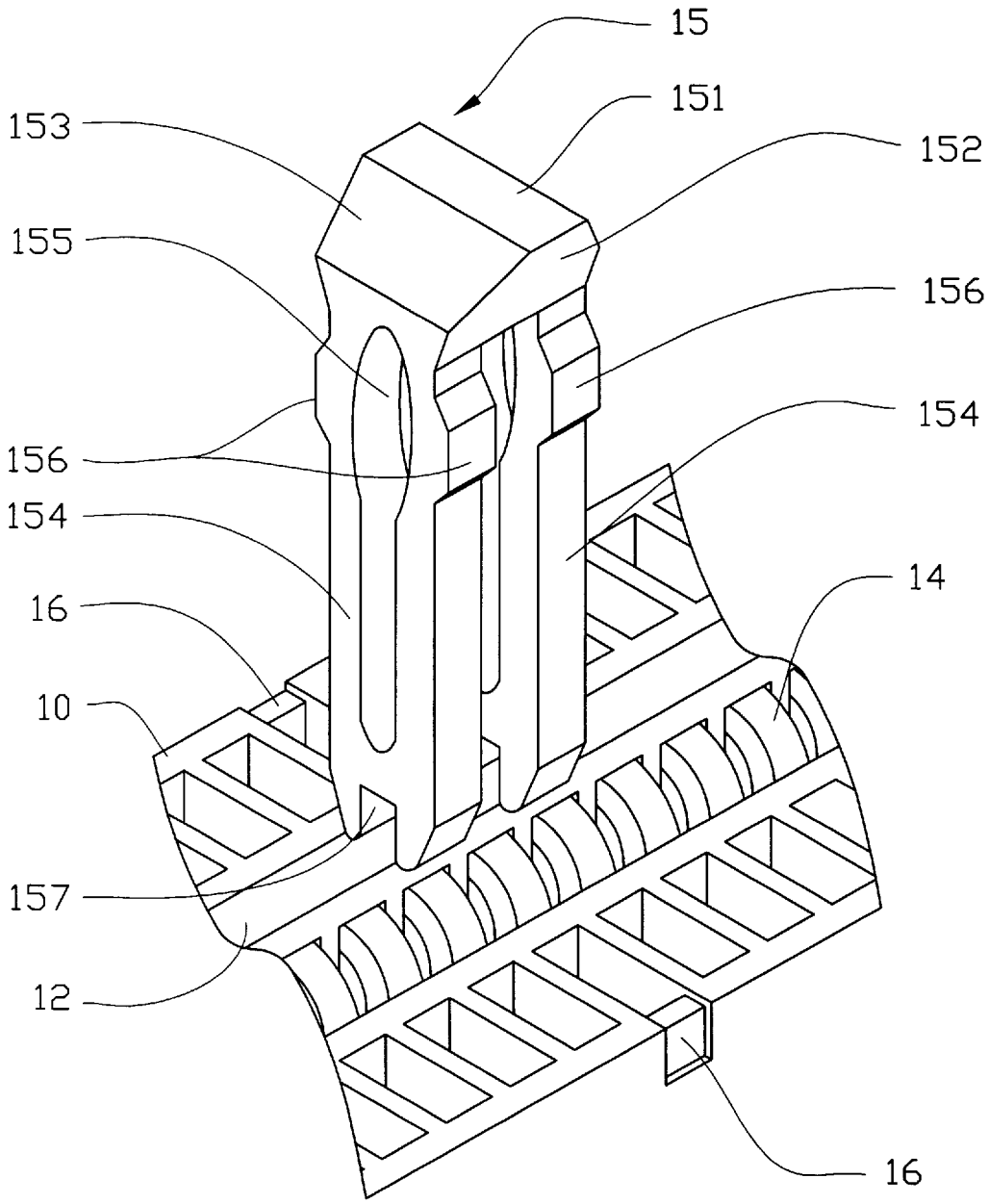
FIG. 4 is a partially cut-away, enlarged perspective view of the card edge connector and the removable positioning key shown in FIG. 3A.

Please refer to FIG. 4. Each of the removable positioning keys 15 comprises a main body 151, and a pair of fixing legs 154 integrally extending downward of the main body 151 with a space formed therebetween. The main body 151 defines two pair of opposite slant surfaces 152, 153 formed on four sides thereof. The pair of opposite slant surfaces 152 have a slope the same as that of the chamfered surfaces 12 of the slot 11 for confronting downward thereto. The opposite slant surfaces 153 face upward.

The fixing legs 154 are plate-like members aligned in the longitudinal direction of the insulating housing 10 and define respective planes parallel to each other and perpendicular to the longitudinal direction of the insulating housing 10. Each of the fixing legs 154 comprises a pair of protrusions 156 on both lateral edges thereof for interfering fit with lateral walls of the central slot 11 of the insulating housing 10, a recess 157 on a central bottom thereof for riding on the central ridge 13 of the insulating housing, and an opening 155 in a central portion thereof for providing space for inward movement of the lateral protrusions 156 while the lateral protrusions 156 are squeezed by the lateral walls of the slot 11. In one preferred embodiment, the central opening 155 includes an upper wider aperture and a lower narrower aperture (both not labeled), and the lateral protrusions 156 are formed adjacent to the larger aperture. The distance between the fixing legs 154 is larger than the width of the conductive contacts 14 so that the fixing legs 154 will not touch the conductive contacts 14, which avoids damaging of the conductive contacts 14 thereby.

When the removable positioning key 15 is mounted onto the insulating housing 10, a suitable marking shallows 16 is located and identified, and the removable positioning key 15 is inserted into the central slot 11 with the slant surfaces 152 resting on the chamfered surfaces 12, the lateral protrusions 156 urging against the inner walls of the slot 11, and the bottom recess 157 riding snugly on the ridge 13 so as to be firmly fixed in the slot 11. Because of the resilience or inward movement of the lateral protrusions 156 provided by the central opening 155, fracture of the fixing legs 154 due to over-stressing can be avoided. With these removable positioning keys 15 suitably located, a user or an assembler can correctly insert different daughter boards.

When the removable positioning key 15 is removed from the insulating housing 10, a tool with a hook can be used to reach this end by extending the hook through the central opening 155 and pulling upward to lift the removable positioning key 15.

Figure 5:
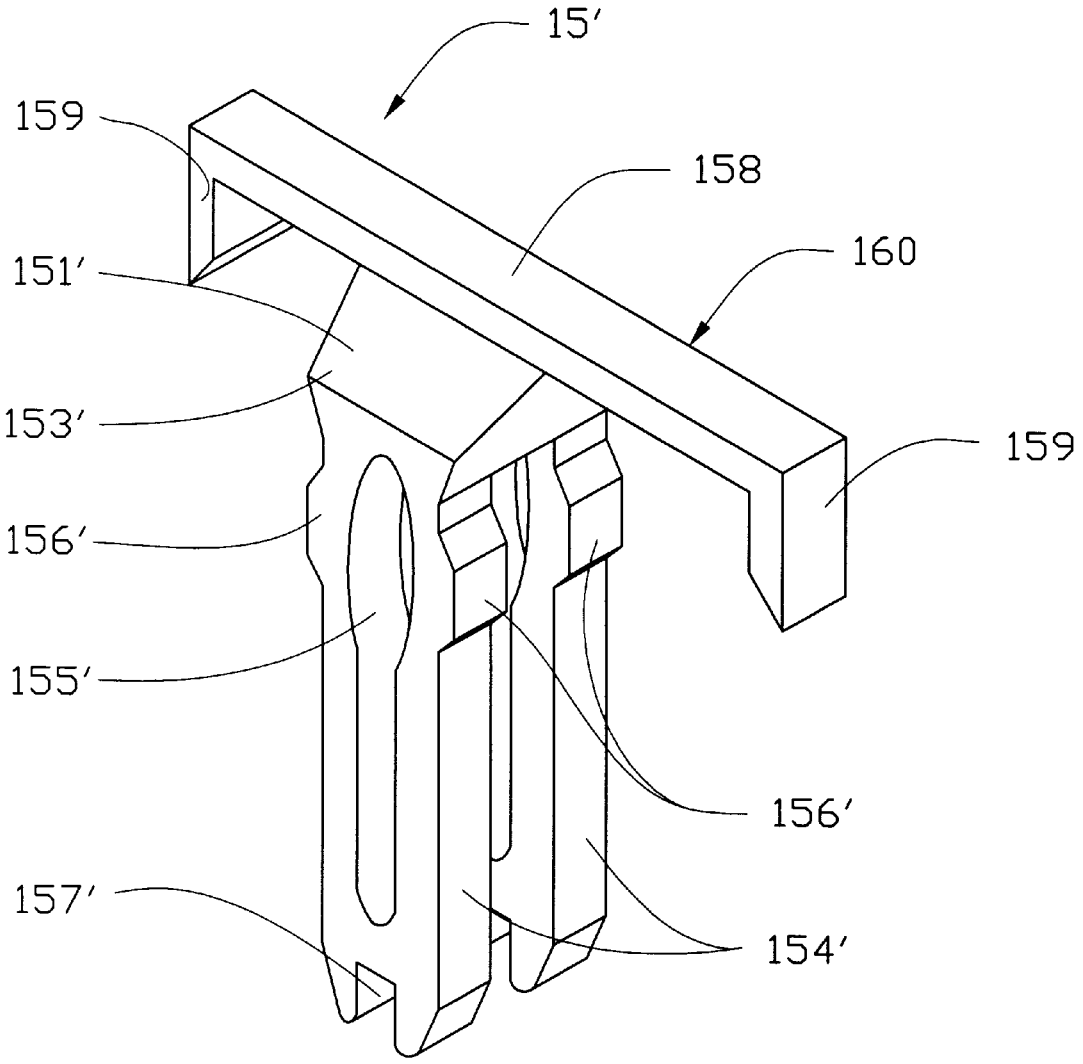
FIG. 5 is a perspective view of the removable positioning key of the card edge connector according to another embodiment of the present invention.

Please now refer to FIG. 5, in which a removable positioning key 15' according to another embodiment of the present invention is shown. The removable positioning key 15' comprises a main body 151', a pair of plate-like fixing legs 154' integrally extending downward of the main body 151', which elements 151' and 154' substantially the same as those illustrated in the first embodiment shown in FIG. 3. The removable positioning key 15', however, further comprises removing means 160 on a top of the main body 151'. The removing means 160 comprises a horizontal elongate strip 158 extending parallel to planes defined by the plate-like fixing legs 154', and two holding plates 159 extending downward of both ends of the strip 158. The distance between outer surfaces of the two holding plates 159 is the same as the width of the insulating housing 10 so that a user or an assembler can remove the removable positioning key 15' simply by holding with fingers the holding plates 159 and pulling upward without any tool.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A card edge connector, comprising:

an elongate insulating housing, including a central slot extending along a longitudinal direction thereof for receiving a daughter board;

a plurality of conductive contacts provided on longitudinal sides of the central slot for mating with contact fingers formed on the daughter board;

at least one removable positioning key fixed in the insulating housing for matching a cutout formed between two adjacent contact fingers of the daughter board, said at least one removable positioning key including a main body, and at least one fixing leg extending downward of the main body and inserted in the central slot; and wherein said at least one fixing leg comprises further a bottom recess for riding on a central ridge extending on a bottom of the central slot along the longitudinal direction of the insulation housing.

2. The card edge connector as claimed in claim 1, wherein said insulating housing further comprises at least one marking shallows formed thereon for pointing out a suitable location for the at least one removable positioning key.

3. The card edge connector as claimed in claim 1, wherein said at least one fixing leg comprises at least one lateral protrusion urging on an inner wall of the central slot.

4. The card edge connector as claimed in claim 3, wherein said at least one fixing leg comprises an opening in a central portion for providing an inward movement of the protrusion while said protrusion engaging with the inner wall of the central slot.

5. The card edge connector as claimed in claim 1, wherein said at least one fixing leg includes a pair of fixing legs spaced apart by a distance larger than the width of the conductive contacts.

6. The card edge connector as claimed in claim 1, wherein said at least one removable positioning key further comprises removing means for manually removing from the central slot.

7. The card edge connector as claimed in claim 6, wherein said removing means comprises a horizontal elongate strip formed on a top of the removable positioning key and extending perpendicular to the longitudinal direction of the insulating housing, and two holding plates extending downward of both ends of the strip for holding by fingers.

8. The card edge connector as claimed in claim 7, wherein a distance between outer surfaces of the holding plates are substantially the same as the width of the insulating housing.

9. The card edge connector as claimed in claim 1, further comprising chamfered surfaces formed on rim portions of the central slot.

10. The card edge connector as claimed in claim 9, wherein said main body of the at least one fixing leg includes a pair of opposite slant surfaces resting on the chamfered surfaces.

11. The card edge connector as claimed in claim 10, wherein said pair of opposite slant surfaces have the same slope as that of the chamfered surfaces for confronting thereto.

12. A card edge connector, comprising:

an elongate insulating housing, including a central slot extending along a longitudinal direction thereof for receiving a daughter board;

a plurality of conductive contacts provided on longitudinal sides of the central slot for mating with contact fingers formed on the daughter board;

at least one removable positioning key fixed in the insulating housing for matching a cutout formed between two adjacent contact fingers of the daughter board, said at least one removable position key comprising removing means for manually removing from the central slot; and wherein said removing means comprises a horizontal elongate strip formed on a top of the removable positioning key and extending perpendicular to the longitudinal direction of the insulating housing, and two holding plates extending downward of both ends of the strip for holding by fingers.

* * * * *